US006884211B2

(12) United States Patent
Lévano et al.

(10) Patent No.: US 6,884,211 B2
(45) Date of Patent: Apr. 26, 2005

(54) NEONATAL ARTIFICIAL BUBBLE

(75) Inventors: Claudio Bruno Castillón Lévano, Lima (PE); Eduardo Ajito Lam, Callao (PE)

(73) Assignee: Pontifica Universidad Catolica Del Peru, San Miguel (PE)

( * ) Notice: Subject to any disclaimer, the term of this patent is extended or adjusted under 35 U.S.C. 154(b) by 0 days.

(21) Appl. No.: 10/617,554

(22) Filed: Jul. 11, 2003

(65) Prior Publication Data

US 2004/0133064 A1 Jul. 8, 2004

(51) Int. Cl.[7] ..... A61G 11/00
(52) U.S. Cl. ..... 600/22
(58) Field of Search ..... 5/626–628, 600; 312/1–6; 600/21, 22; 128/205.26, 202.12

(56) References Cited

U.S. PATENT DOCUMENTS

| | | | | |
|---|---|---|---|---|
| 2,347,326 A | | 4/1944 | Kirschbaum | |
| 3,076,451 A | | 2/1963 | Stoner et al. | |
| 3,335,713 A | | 8/1967 | Grosholz et al. | |
| 3,821,947 A | | 7/1974 | Schossow | |
| 4,321,913 A | * | 3/1982 | Maluta et al. | 600/22 |
| 4,681,090 A | | 7/1987 | Koch | |
| 4,750,474 A | | 6/1988 | Dukhan et al. | |
| 5,006,105 A | * | 4/1991 | Sherard | 600/22 |
| 5,100,375 A | | 3/1992 | Koch | |
| 5,242,375 A | | 9/1993 | McDonough | |
| 5,330,415 A | | 7/1994 | Storti et al. | |
| 5,707,337 A | * | 1/1998 | Franz | 600/22 |
| 5,730,355 A | | 3/1998 | Lessard et al. | |
| 5,797,833 A | | 8/1998 | Kobayashi et al. | |
| 5,840,010 A | | 11/1998 | Kobayashi et al. | |
| 6,180,397 B1 | * | 1/2001 | Binder | 435/303.1 |
| 6,210,320 B1 | | 4/2001 | Rogone et al. | |
| 6,270,452 B1 | | 8/2001 | Donnelly et al. | |
| 6,511,414 B1 | | 1/2003 | Hansund | |

FOREIGN PATENT DOCUMENTS

| | | |
|---|---|---|
| DE | 198 40 716 A1 | 3/1999 |
| EP | 0 291 280 A1 | 11/1988 |
| EP | 0 880 987 A2 | 12/1998 |
| EP | 0 931 535 A1 | 7/1999 |
| EP | 0 933 075 A2 | 8/1999 |
| EP | 1 044 668 A1 | 10/2000 |
| ES | 2 062 584 | 12/1984 |
| ES | 2 157 402 | 8/2001 |
| JP | 56-66255 | 6/1981 |
| UA | 1546734 | 5/1979 |
| WO | WO 90/09771 | 9/1990 |
| WO | WO 98/48755 | 11/1998 |
| WO | WO 99/21526 | 5/1999 |
| WO | WO 01/91691 A1 | 12/2001 |

* cited by examiner

*Primary Examiner*—Samuel G. Gilbert
(74) *Attorney, Agent, or Firm*—Brandon N. Sklar; Kaye Scholer LLP

(57) ABSTRACT

A medical device is provided for improving the intensive care of high-risk newborns. The device comprises a tempered air closed circuit enclosing a neonatal capsule and comprising a dome composed of two concentric layers defining an intra-dome space therebetween, through which tempered air can circulate, to maintain the temperature in the intermediate artificial environment created between the neonatal capsule and the tempered air closed circuit. A continuous ventilation circuit is provided comprising air and oxygen inlet lines and a mixture outlet line, to administer a continuous and regulated air flow of filtered, oxygenated, tempered and humidified air to the newborn child inside the neonatal capsule. A set of doors may be provided through the neonatal capsule and dome, to provide access inside the neonatal capsule.

11 Claims, 3 Drawing Sheets

NEONATAL ARTIFICIAL BUBBLE

FIELD OF THE INVENTION

A medical device and, more particularly, an incubator, such as an incubator for newborns.

BACKGROUND OF THE INVENTION

The invention's background is the baby incubator, which is the main medical device for the care of high-risk newborns.

The following patents present models of incubators, systems and devices for the care of high-risk newborns.

U.S. Pat. No. 2,347,326 (1944) presents a device composed of a child resuscitator and a newborn incubator.

U.S. Pat. No. 3,076,451 (1963) presents the design of a series of devices installed in an incubator to improve the regulation of temperature, humidity and oxygenation for newborns.

U.S. Pat. No. 3,335,713 (1967) presents the most widespread fuctional scheme, adopted by several manufacturers for the design of incubators. It is based on a system consisting of a ventilation circuit for the transfer of heat by convection and the gain of humidity by the passing of air through a water-containing vessel in the same ventilation flow circuit.

GB Patent 1,546,734 (1979) presents the design of a ventilation system connected directly to the environment that houses the newborn in the incubator.

JP Patent 56,066,255 (1981), EP Patent 0291280 (1988), U.S. Pat. No. 5,797,833 (1988), WO 9,848,755 (1988), U.S. Pat. No. 5,797,833 (1998), U.S. Pat. No. 5,730,355 (1998), U.S. Pat. No. 5,840,010 (1998) present the design of incubators with a double wall cupola that originates an air curtain in the main access door.

U.S. Pat. No. 4,750,474 (1988) presents the design of an incubator with a double wall cylinder-shaped climatic chamber, where the air flow circulates between the walls and around the newborn child.

WO 9,921,526 (1999) presents the design of a heating system for baby incubators with a double wall, where the air flow circulates between both walls of the cupola and around the newborn Currently available incubators have not succeeded in reducing the risk of contamination among newborns, or the noise generated by the fan when mobilizing the air towards the child. In addition, they do not achieve a uniform temperature in the environment that contains the newborn. These main problems and other secondary ones such as: the excessive consumptions of oxygen, electric power, and microbial filters, have motivated the development of a device that improves the care of high-risk newborns.

SUMMARY OF THE INVENTION

A medical device is disclosed for improving the intensive care of high-risk newborns, comprising a neonatal capsule hermetically closed to prevent contamination of the child by the external environment. The neonatal capsule is connected to an air feeding means for alimenting the newborn child within the capsule with sterile air. The device further comprises:

(i) a tempered air closed circuit enclosing said neonatal capsule and comprising a dome composed of two concentric layers defining an intra-dome space therebetween, through which tempered air can circulate, the tempered air closed circuit further comprising a thermal base container complementarily connected to the dome, said thermal base container comprising a fan and an electric heater so as to generate tempered air circulation within the intra-dome space to maintain the temperature in the intermediate artificial environment created between the neonatal capsule and the tempered air closed circuit, (ii) a continuous ventilation circuit for administrating a continuous and regulated air flow of filtered, oxygenated, tempered and humidified air to the newborn child inside the neonatal capsule, said continuous ventilation circuit comprising an air line and an oxygen line, both connected to a gas collector line, the latter being connected to the neonatal capsule for feeding air thereinto, the continuous ventilation circuit further comprising a mixture outlet line for allowing gas to exit from said neonatal capsule, (iii) access means providing access inside said neonatal capsule from the exterior environment.

Preferably, said access means comprise:

(a) two doors of the dome, each door having a double layer defining a space therebetween through which tempered air can flow, each door comprising two perforated axles in its base portion that serve to join together said door and the dome by insertion into corresponding holes located in the vertexes of the base of the dome, and also serve the purpose of letting air flow between the two layers, and (b) four circular doors (12) in the cover of the neonatal capsule.

Also preferably, the neonatal capsule is disposable.

In a preferred embodiment of the present invention, the thermal base container comprises acoustic filters to reduce noise generated by the air flow therein.

The double layer dome and the layer of the neonatal capsule are advantageously transparent, so as to allow observation of the newborn child within the neonatal capsule, from the exterior of said medical appliance, without the need to open it.

The body of the thermal base is preferably externally covered by a layer of thermal insulation material.

The fan of the thermal base container is also preferably of low revolution and comprises wide vanes.

In a preferred embodiment of the present invention, the oxygen line comprises an oxygen receiver, a microbial filter, a check valve, a proportionate flow valve, and a flow sensor, so that oxygen is administrated in electronically controlled quantities to the gas collection line.

The air line preferably comprises an air generator for acquiring air from the external environment, a microbial filter, a check valve, a proportionate flow valve, and a flow sensor, so that air is administrated in electronically controlled quantities to the gas collection line.

Also preferably, the gas collection line comprises an electronically controlled heater for tempering air mixed from the air and oxygen lines, and an humidifier comprising a recipient filled with distilled water.

The mixture outlet line advantageously comprises a bacterial filter, as well as flow, temperature, and relative humidity sensors, in order to supervise the condition of the mixture air that is administrated to the newborn.

BRIEF DESCRIPTION OF THE DRAWINGS

One particular, non limiting, embodiment of the invention will now be described in further detail with reference to the accompanying drawings, in which.

DETAILED DESCRIPTION OF THE PREFERRED EMBODIMENTS

The neonatal artificial bubble is a medical device designed to improve the quality of intensive care of high-risk newborns in hospital's intensive care units of the neonatology area. This device provides the newborn with air and oxygen mixed, filtered, tempered and humidified, in a sterile environment (i.e. the neonatal capsule) with a low level of sonorous noise and uniform temperature.

Figure 1:
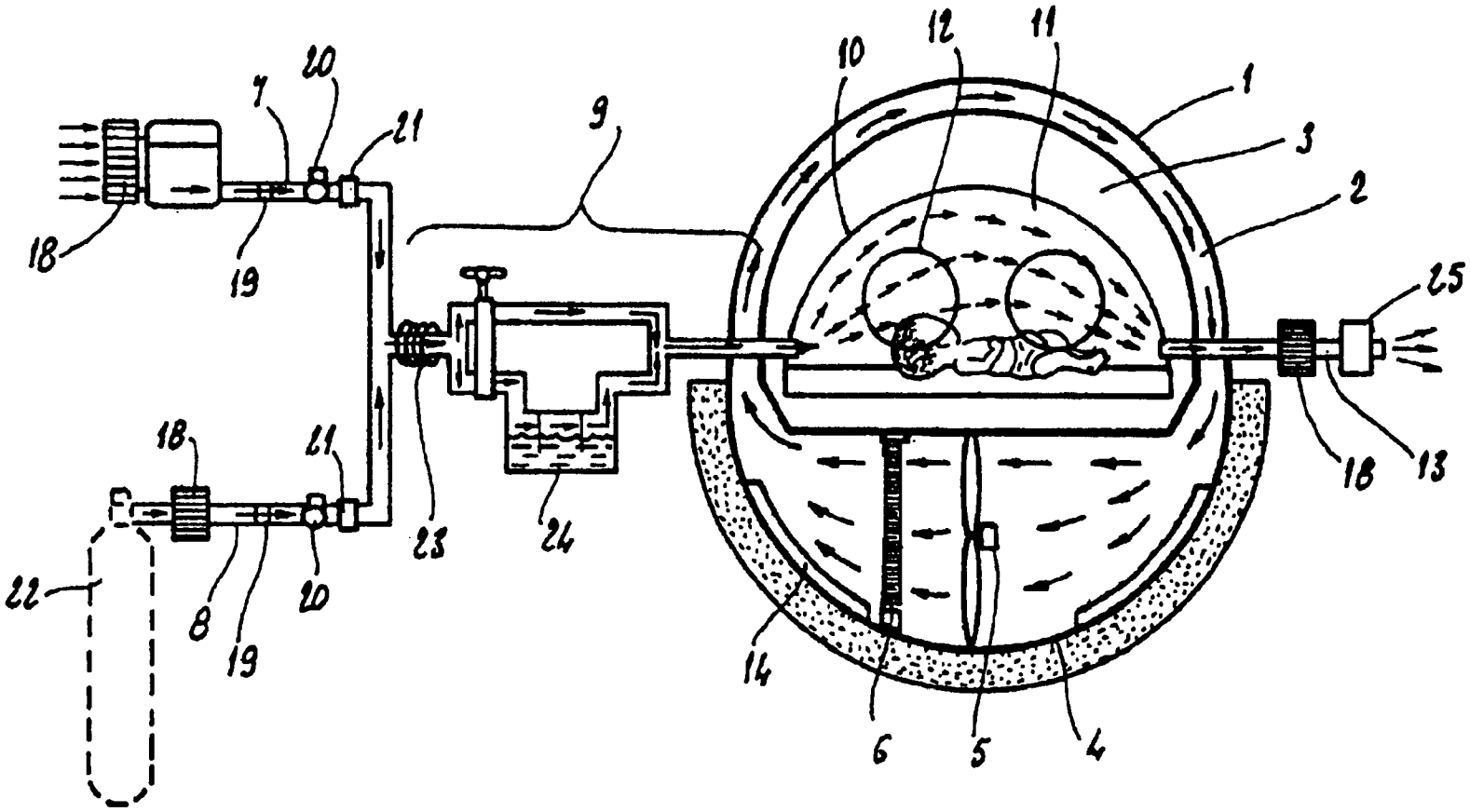
FIG. 1 Is a schematic profile view of a medical device according to an embodiment of the invention.

Due to the functional analogy between the invention and the bubble concept (hermetic space isolated from the external environment—thus defined by the Real Academia Espa ñola), this device has been denominated neonatal artificial bubble (FIG. 1).

The neonatal artificial bubble is a system that consists of two gas flow circuits, namely:

1.—a tempered air closed circuit, and

2.—a continuous ventilation circuit.

1.—Tempered Air Closed Circuit

Figure 2:
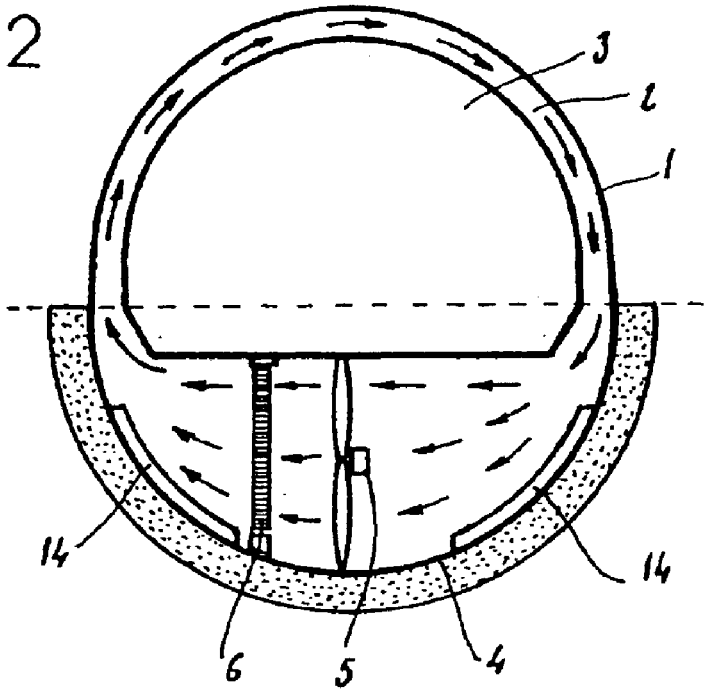
FIG. 2 is a schematic, enlarged, profile view of the dome in a medical device according to the embodiment of FIG. 1.

As shown in FIG. 2, this circuit retains and maintains a uniform temperature in the intermediate artificial environment 3 (i.e. the environment that houses the neonatal capsule 10), using a heater 6 and a fan 5 that generate a flow of tempered air that is used as a means of heat propagation. This circuit is not in contact with the newborn, a feature that allows the installation of acoustic filters 14 to reduce noise. In order to minimize the level of noise even further, the fan 5 used is of low revolution and has wide vanes. Its capacity to retain calorific energy allows saving electric power.

The parts of this circuit are the dome 1 and the thermal base 4. Both are complementarily connected to form the closed circuit through which the tempered air flow will circulate.

1.1.—The Dome

The dome 1 allows retaining and maintaining the uniform temperature of the intermediate artificial environment 3, and physically protects the newborn from the external environment. The dome 1 is double-layered and made of transparent material that allows observing the child. The neonatal capsule 10 which contains the newborn is accessed through two doors, a front one 15 and a back one 16.

Figure 4:
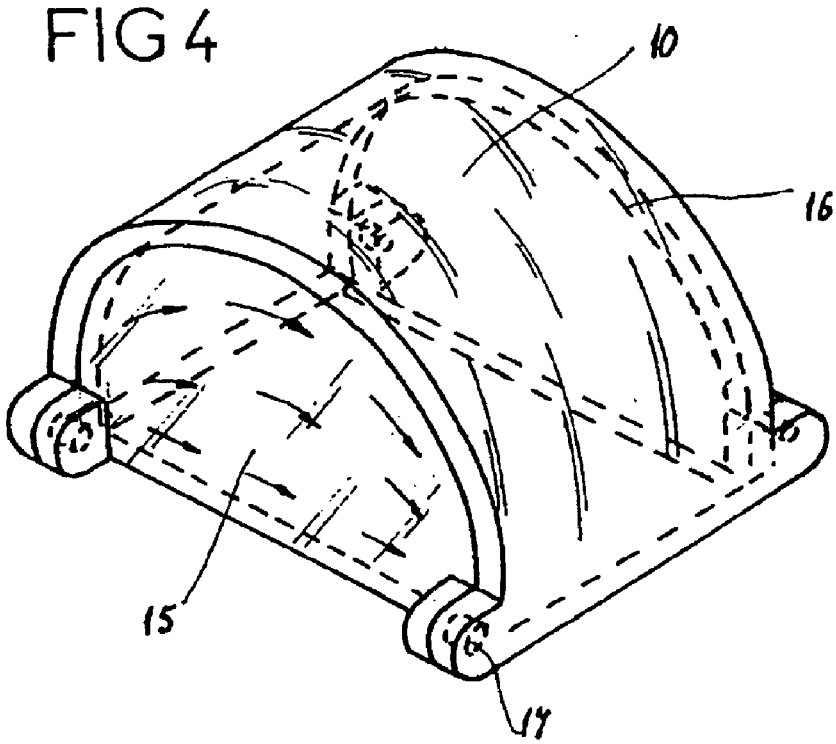
FIG. 4 is a schematic perspective view of the dome in a device according to the embodiment of FIG. 1.

The body of the dome 1 is conformed by two layers that are two concentric cylindrical half surfaces. Between these two layers there is a space 2 through which the tempered air flows. This space is denominated intra-dome space 2. As shown in FIG. 1, this space 2 is communicated with the thermal base 4 through its ends and allows improving the thermal isolation of the intermediate artificial environment 3. As shown in FIG. 4, the intra-dome space 2 forms a rectangular section curved conduit, closed in its front and back ends. In the vertexes of the base of the dome 1, there are four holes 17 that are part of the hinges of the semicircular doors (15,16) while at the same time constituting the tempered air conduits for the doors, as shown in FIG. 4.

The dome's semi-circular front door 15 and back door 16 provide access to the neonatal capsule 10 therein; the doors are double-layered in order to form a space therebetween through which the tempered air flow will also circulate, as shown in FIG. 4. These doors are used to close the internal environment of the body of the dome that has been denominated intermediate artificial environment 3, and also to access the neonatal capsule 10. In the base of the doors there are two perforated axles that serve to join together with the dome and also to let the tempered air flow between the layers of each door. These axles are part of the hinges, and also serve the purpose of joining the doors to the body of the dome, as shown in FIG. 4, by cooperating with the holes 17 at the base of the dome.

1.2.—Thermal Base

The thermal base 4 is a container complementarily connected through its ends to the dome 1, as shown in FIG. 2, both of them conforming the tempered air closed circuit. Inside the thermal base in the transverse plane section there is a fan 5, and in front of it an electronically controlled electric heater 6. The function of the thermal base 4 is to generate and heat the air that circulates through the intra-dome space 2. The body of the thermal base 4 is externally covered by a layer of thermal insulation material to retain temperature.

The elements responsible for the high level of sonorous noise in incubators or conventional equipment are the fan and the air flow it generates. This flow is in contact with the environment occupied by the newborn child. In this embodiment of the invention, the air flow generated by the fan 5 that is used as a means of heat propagation, is not in contact with the child. This feature allows the installation of synthetic foams as acoustic filters 14 inside the thermal base 4 in order to reduce the noise. Due to their location, isolated from the newborn, these foams do not require sterilizing. In order to minimize the noise to an even greater extent, the fan 5 used is of low revolution and has wide vanes.

2.—Continuous Ventilation Circuit

Figure 3:
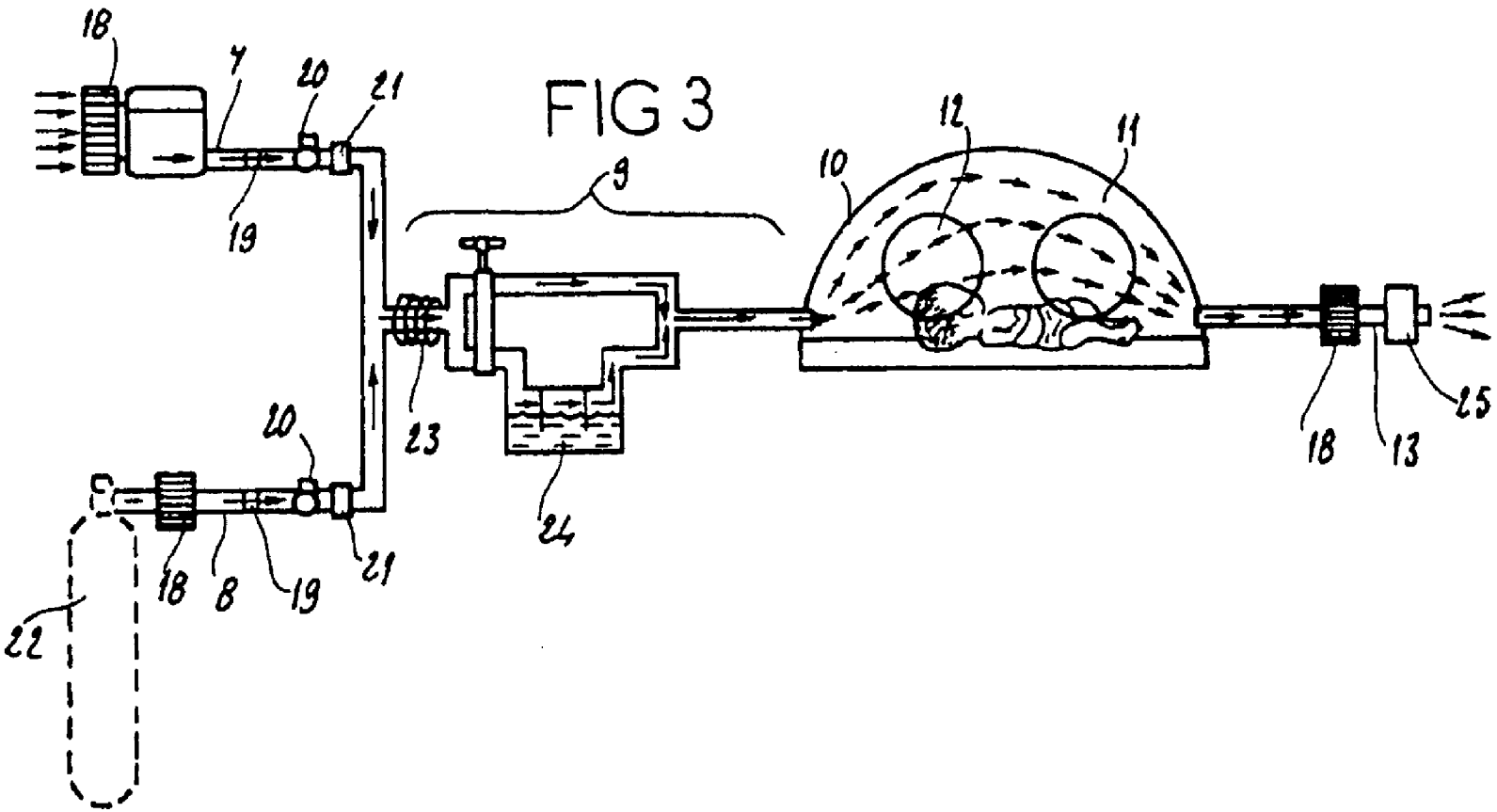
FIG. 3 is a general schematic view of the continuous ventilation circuit and neonatal capsule according to the embodiment of FIG. 1.

As shown in FIG. 3, the continuous ventilation circuit is a set of pneumatic devices consecutively connected to ventilate the newborn with a continuous flow of filtered, oxygenated, tempered and humidified air. The quantity of this gas is regulated according to the requirements of each child, which allows using a lower quantity of oxygen and provides increased time to the bacterial filters.

The circuit consists of two parts: the ventilation circuit and the neonatal capsule 10.

2.1.—The Ventilation Circuit

Also named gas line circuit, it is in charge of administering a medicinal gaseous mixture to the newborn inside the neonatal capsule 10. It is conformed by an air line 7, an oxygen line 8, a gas collection line 9, and a mixture outlet line 13.

2.1.1.—Air Line

The air line is the conduit through which the external environment air is acquired by means of an air generator that mobilizes the gaseous fluid. The air is previously filtered by using a microbial filter 18, and conveyed to the gas collection line 9. A check valve 19, a proportionate flow valve 20, a flow sensor 21 and optionally an air pump are consecutively installed on this line; the air line administers the air in electronically controlled quantities.

2.1.2.—Oxygen Line

The oxygen line is consecutively conformed by: an oxygen receiver 22, a microbial filter 18, a check valve 19, a proportionate flow valve 20, and a flow sensor 21. Oxygen is administered in electronically controlled quantities through this line to the gas collection line 9.

2.1.3.—Gas Collection Line

The gas collection line is a conduit where the air line 7 and the oxygen line 8 converge. In this line, gases are mixed, heated by means of an electronically controlled heater 23, and humidified by means of a recipient 24—or vessel—that contains distilled water. This pre-defined gaseous mixture enters the neonatal cupola 10.

2.1.4.—Mixture Outlet Line

The mixture of gases coming from the neonatal cupola 10 flows out to the external environment through this line. Installed on this line are a bacterial filter 18, and flow, temperature and relative humidity sensors 25 to supervise the condition of the mixture that is administered to the newborn.

2.2.—The Neonatal Capsule

The neonatal capsule is a closed space where the newborn is housed, its wall is transparent, of a thin thickness and thermoformable material. This is where the newborn is placed. The capsule is designed to be disposed of after housing each child, in order to prevent contamination between each newborn that enters the equipment.

The neonatal capsule is conformed by a cupola-shaped cover and a lower base that rests on a platform on the Thermal Base 4. Both components are hermetically closed to contain the gaseous mixture that is administered by means of the ventilation circuit. The gaseous mixture enters the Internal artificial environment 11 through one end of the neonatal capsule 10—preferably the end in which the newborn's head is—, and flows out the other end to the mixture outlet line 13, where the flow, temperature and relative humidity sensors are installed to supervise the condition of the air that is administered to the newborn.

The cover of the neonatal capsule 10 has four circular doors 12 that allow tending to the newborn directly. The placing of the newborn in the capsule requires removing the cover of the lower base and accommodating the newborn on a sprung bed base installed on the lower base of the neonatal capsule.

We claim:

1. A medical device, comprising:

a neonatal capsule hermetically closed to prevent contamination of the child by the external environment, said neonatal capsule being connected to an air feeding means for alimenting the newborn child within the capsule with sterile air;

a tempered air closed circuit enclosing said neonatal capsule, the circuit comprising a dome composed of two concentric layers defining an intra-dome space therebetween, through which tempered air can circulate, the tempered air closed circuit further comprising a thermal base container complementarily connected to the dome, said thermal base container comprising a fan and an electric heater so as to generate tempered air circulation within the intra-dome space to maintain the temperature in an intermediate artificial environment created between the neonatal capsule and the tempered air closed circuit;

a continuous ventilation circuit to administer a continuous and regulated air flow of filtered, oxygenated, tempered and humidified air to the newborn child inside the neonatal capsule, said continuous ventilation circuit comprising an air line and an oxygen line, both connected to a gas collector line, the collector line being connected to the neonatal capsule to feed air thereto, the continuous ventilation circuit further comprising a mixture outlet line to allow gas to exit from said neonatal capsule; and access means providing access inside said neonatal capsule from the exterior environment.

2. The medical device of claim 1, wherein said access means comprises:

two doors of the dome, each door having a double layer defining a space therebetween through which tempered air can flow, each door comprising two perforated axles in its base portion that serve to join together said door and the dome by insertion into corresponding holes located in the vertexes of the base of the dome, and also serve the purpose of letting air flow between the two layers; and four circular doors in the cover of the neonatal capsule.

3. The medical device of claim 1, wherein the neonatal capsule is disposable.

4. The medical device of claim 1, wherein the thermal base container comprises acoustic filters to reduce noise generated by the air flow therein.

5. The medical device of claim 1, wherein the double layer dome and the layer of the neonatal capsule are transparent, so as to allow observation of the newborn child within the neonatal capsule, from the exterior of said medical appliance.

6. The medical device of claim 1, wherein the body of the thermal base is externally covered by a layer of thermal insulation material.

7. The medical device of claim 1, wherein the fan of the thermal base container is of low revolution and comprises wide vanes.

8. The medical device of claim 1, wherein the oxygen line comprises an oxygen receiver, a microbial filter, a check valve, a proportionate flow valve, and a flow sensor, so that oxygen is administrated in electronically controlled quantities to the gas collection line.

9. The medical device of claim 1, wherein the air line comprises an air generator for acquiring air from the external environment, a microbial filter, a check valve, a proportionate flow valve, and a flow sensor, so that air is administrated in electronically controlled quantities to the gas collection line.

10. The medical device of claim 1, wherein the gas collection line comprises an electronically controlled heater for tempering air mixed from the air and oxygen lines, and an humidifier comprising a recipient filled with distilled water.

11. The medical device of claim 1, wherein the mixture outlet line comprises a bacterial filter, as well as flow, temperature, and relative humidity sensors, in order to supervise the condition of the mixture air that is administrated to the newborn.

* * * * *